US007836861B2

(12) United States Patent
Tanabe et al.

(10) Patent No.: US 7,836,861 B2
(45) Date of Patent: Nov. 23, 2010

(54) VARIABLE VALVE MECHANISM FOR INTERNAL COMBUSTION ENGINE

(75) Inventors: Mikio Tanabe, Obu (JP); Hideo Nakai, Suita (JP); Satoshi Yoshikawa, Otsu (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 298 days.

(21) Appl. No.: 12/071,479

(22) Filed: Feb. 21, 2008

(65) Prior Publication Data

US 2008/0202459 A1 Aug. 28, 2008

(30) Foreign Application Priority Data

Feb. 22, 2007 (JP) ..... 2007-042466
Feb. 28, 2007 (JP) ..... 2007-050239

(51) Int. Cl.
*F01L 1/18* (2006.01)

(52) U.S. Cl. ..... 123/90.39; 123/90.16; 123/90.31; 123/90.44; 74/559; 74/569

(58) Field of Classification Search ..... 123/90.16, 123/90.39, 90.44, 90.6, 90.31; 74/559, 567, 74/569

See application file for complete search history.

(56) References Cited

U.S. PATENT DOCUMENTS

| | | | | |
|---|---|---|---|---|
| 7,314,027 | B2 * | 1/2008 | Murata | 123/90.16 |
| 2005/0028766 | A1 | 2/2005 | Schon et al. | |
| 2005/0224028 | A1 | 10/2005 | Murata | |
| 2005/0274340 | A1 | 12/2005 | Murata | |

FOREIGN PATENT DOCUMENTS

| | | | |
|---|---|---|---|
| EP | 1 710 402 | A1 | 10/2006 |
| EP | 1 754 865 | A2 | 2/2007 |
| EP | 1 918 536 | A1 | 5/2008 |
| JP | 9-195724 | A | 7/1997 |
| JP | 9-217607 | A | 8/1997 |
| JP | 11-6413 | A | 1/1999 |
| JP | 2000-38907 | A | 2/2000 |
| JP | 2001-090729 | A | 4/2001 |
| JP | 3183127 | B2 | 4/2001 |
| JP | 2002-122133 | A | 4/2002 |
| JP | 2003-314545 | A | 11/2003 |
| JP | 2004-211687 | A | 7/2004 |

(Continued)

*Primary Examiner*—Ching Chang
(74) *Attorney, Agent, or Firm*—Birch, Stewart, Kolasch & Birch, LLP

(57) ABSTRACT

A variable valve mechanism for an internal combustion engine includes a rocker arm, a swing cam, and a transmission member which is interposed between the swing cam and a cam and transmits the displacement of the cam to the swing cam. The rocker arm is provided with a rolling roller member which includes a inner ring, an outer ring, and a plurality of rolling elements accommodated between the inner ring and the outer ring. The outer ring contacts with the swing cam. At least one of a first transmission part, in which the displacement of the cam is transmitted from the cam to the transmission member, and a second transmission part, in which the displacement of the cam is transmitted from the transmission member to the swing cam, includes a sliding roller member, wherein a sliding bearing mechanism is constituted between the sliding roller member and the support part.

5 Claims, 10 Drawing Sheets

FOREIGN PATENT DOCUMENTS

| | | | |
|---|---|---|---|
| JP | 2005-514553 | A | 5/2005 |
| JP | 2005-299536 | A | 10/2005 |
| JP | 2006-118399 | A | 5/2006 |
| JP | 2006-144742 | A | 6/2006 |
| JP | 2007-40291 | A | 2/2007 |

* cited by examiner

VARIABLE VALVE MECHANISM FOR INTERNAL COMBUSTION ENGINE

CROSS-REFERENCE TO RELATED APPLICATIONS

This application is based upon and claims the benefit of priority from prior Japanese Patent Applications No. 2007-042466, filed Feb. 22, 2007; and No. 2007-050239, filed Feb. 28, 2007, the entire contents of both of which are incorporated herein by reference.

BACKGROUND OF THE INVENTION

1. Field of the Invention

The present invention relates to a variable valve mechanism for an internal combustion engine which varies a phase of an intake valve or exhaust valve.

2. Description of the Related Art

From the viewpoint of suppression of exhaust gas from an engine, many variable valve mechanisms for an engine mounted in a vehicle are configured to adjust opening and closing times of inlet and exhaust valves or to adjust the opening period of these valves.

As an example of the constitution of the variable valve mechanism, for example, there is proposed a constitution to transmit the displacement of a cam lift of a cam, which is provided in a camshaft, to a reciprocating swing cam, in which a base circular section and a lift section are continuous to each other, by using a center rocker arm as a transmission member, and thereby to drive an inlet valve and an exhaust valve by a rocker arm driven by the swing cam.

The posture of the center rocker arm is adjusted by, for example, an actuator. When the posture of the center rocker arm is changed, a position contacting with a cam is changed in the center rocker arm, and at the same time, a position contacting with the swing cam is changed in the center rocker arm. As a result, the operations in the inlet valve and the exhaust valve are changed.

As mentioned above, the cam and the center rocker arm come into contact with each other, and at the same time, the center rocker arm and the swing cam come into contact with each other, whereby the swing cam and the rocker arm come into contact with each other.

Specifically, a roll-like cam follower is provided in the center rocker arm. The cam follower is in rolling contact with the cam. A surface coming into slidable contact with the front end surface of the center rocker arm is formed in the swing cam. The rocker arm is provided with a roller member. The swing cam is in rolling contact with the roller member. Such a technique is disclosed in Jpn. Pat. Appln. KOKAI Publication No. 2005-299536.

As mentioned above, the variable valve mechanism is provided with a plurality of components, that is, the center rocker arm, the swing cam, and the rocker arm. When the adjacent components of these components (e.g., combination of the cam and the center rocker arm, combination of the center rocker arm and the swing cam, and the combination of the swing cam and the rocker arm) come into contact with each other, and at the same time, slid with each other, it is preferable to provide, in the contact part, an inner ring, an outer ring, and a rolling roller member in which a rolling element is accommodated between the inner ring and the outer ring as with a needle roller member for the purpose of suppressing friction generated at the contact part.

Meanwhile, in the constitution in which the displacement of the cam is transmitted in the order of the center rocker arm, the swing cam, and the rocker arm, as the constitution of the variable valve mechanism disclosed in Jpn. Pat. Appln. KOKAI Publication No. 2005-299536, the load generated in transmitting the displacement of the cam to the components positioned between the valves, that is, the center rocker arm, the swing cam, and the rocker arm acts on the contact part between the cam and center rocker arm and the contact part between the center rocker arm and the swing cam which are far from the valve driven by the variable valve mechanism in a transmission path through which the displacement of the cam is transmitted.

Specifically, the load, which can transmit the displacement of the cam to the valve through the center rocker arm, the swing cam, and the rocker arm, acts on the contact part between the cam and the center rocker arm. Meanwhile, the load, which can transmit the displacement of the cam to a surface through the swing cam and the rocker arm, acts on the contact part between the center rocker arm and the swing cam.

As a result, it is considered that the deformation such as deflection occurs in the contact part between the cam and the center rocker arm and in the contact part between the center rocker arm and the swing cam, thereby generating a loss in the displacement of the cam to be transmitted to the valve driven by the variable valve mechanism. It is unpreferable to generate the loss of the displacement of the cam to be transmitted.

However, the needle roller member having the above constitution is easily deformed with respect to the load acting from the outer ring toward the inner ring. This point will be described in detail as follows. The needle roller member has a plurality of needles accommodated between the outer ring and the inner ring.

When the load acts from the outer ring toward the inner ring, the load is transmitted from the outer ring to the needles. At this time, if the load acts on a gap between the adjacent needles, it is considered that the outer ring is deformed so as to correspond to the gap.

Therefore, if the needle roller member is used in consideration of the friction, it is considered that the loss in the transmission of the displacement of the cam is due to the deformation of the needle roller member.

Meanwhile, in this type of variable valve mechanism described above, the swing cam is provided with a pin member for receiving the displacement of the center rocker arm. Specifically, a groove is provided in the pin member. The groove has a bottom surface, which comes into slidable contact with a front end surface of the center rocker arm in response to the displacement in the posture and position of the center rocker arm while transmitting the displacement of the cam. The front end part of the center rocker arm is accommodated in the groove of the pin member in a slidable manner.

The center rocker arm is then supported by, for example, a rocker shaft for supporting the rocker arm in a swingable manner. The posture of the rocker shaft is adjusted by, for example, an actuator. When the posture of the rocker shaft is changed, the position of a part supported by the rocker shaft is also changed in the center rocker arm. The posture of the center rocker arm is also changed following that change.

When the posture of the center rocker arm is changed, the position contacting with the cam is also changed in the center rocker arm, and at the same time, the position contacting with the swing cam is also changed in the center rocker arm. Thereby, the operation in the inlet and exhaust valves is changed. This kind of technique is disclosed in Jpn. Pat. Appln. KOKAI Publication No. 2005-299536.

As mentioned above, in the variable valve mechanism disclosed in Jpn. Pat. Appln. KOKAI Publication No. 2005-

299536, the cam and the center rocker arm come into contact with each other, the center rocker arm and the swing cam come into contact with each other, and the swing cam and the rocker arm come into contact with each other. Particularly, the center rocker arm and the swing cam come into slidable contact with each other, and thus the contact part between them needs to be lubricated with lubricating oil.

However, as in Jpn. Pat. Appln. KOKAI Publication No. 2005-299536, when the center rocker arm and the swing cam come into slidable contact with each other, the contact area between them becomes relatively larger. Thus, a relatively large amount of lubricating oil is required.

Meanwhile, it is considered that the adjacent components come into line contact with each other by providing a roller member in the contact part between the adjacent components along a transmission path through which the displacement of the cam is transmitted to the valve. The constitution in which the adjacent components come into line contact with each other can reduce the amount of lubricating oil.

Further, it is considered that the lubricating oil is dispersed by the rotation of the roller member. This dispersion of the lubricating oil can realize the lubrication of the components around the contact part such as a support part of the rotation shaft of the roller member.

Meanwhile, the variable valve mechanism disclosed in Jpn. Pat. Appln. KOKAI Publication No. 2005-299536 has the constitution in which the front end surface of the center rocker arm comes into slidable contact with the groove of the pin member provided in the swing cam, whereby the center rocker arm is fitted into the groove to thereby position the center rocker arm.

However, in the constitution using the roller member in the contact part between the center rocker arm and the swing cam, when the center rocker arm is displaced in a different direction from a predetermined displacement direction, it is considered that the center rocker arm assumes a different posture from a predetermined posture.

In this manner, the posture of the center rocker arm with respect to the swing cam and the cam is changed. Specifically, the posture of the front end surface of the center rocker arm with respect to the roller member of the swing cam is changed. If the posture of the front end surface of the center rocker arm with respect to the roller member is changed, the displacement of the cam transmitted to the swing cam through the center rocker arm has an error in the initially determined transmission of the displacement of the cam.

It is considered that such an error causes an error in the displacement of the cam, being transmitted to the valve driven by the variable valve mechanism, against the initially determined displacement of the cam. Thus, it is unpreferable that the center rocker arm being driven assumes a different posture from the predetermined posture.

BRIEF SUMMARY OF THE INVENTION

An object of the present invention is to provide a variable valve mechanism for an internal combustion engine which can suppress transmission loss in displacement of a cam while reducing the friction.

In addition, another object of the invention is to provide a variable valve mechanism for an internal combustion engine which can suppress transmission loss in displacement of a cam while reducing the friction, can realize the lubrication with a small amount of lubricating oil, and can suppress generation of transmission loss in displacement of the cam.

A variable valve mechanism for an internal combustion engine of the invention comprises: a camshaft rotatably provided in an internal combustion engine; a cam formed in the camshaft; a rocker arm which is provided in the internal combustion engine and drives a valve; a swing cam which is swingably provided in the internal combustion engine and drives the rocker arm by receiving displacement of the cam; and a transmission member which is interposed between the swing cam and the cam and transmits the displacement of the cam to the swing cam. The rocker arm comprises a rolling roller member. The rolling roller member is provided with a fixed inner ring, an outer ring provided coaxially with the inner ring and accommodating the inner ring in its inside, and a plurality of rolling elements accommodated between the inner ring and the outer ring and supporting the outer ring in a rotatable manner with respect to the inner ring, and receives the displacement of the swing cam in a state that the outer ring is in rolling contact with the swing cam. In a transmission path through which the displacement of the cam is transmitted to the swing cam, at least one of a first transmission part, in which the displacement of the cam is transmitted from the cam to the transmission member, and a second transmission part, in which the displacement of the cam is transmitted from the transmission member to the swing cam, is provided with a sliding roller member. The sliding roller member transmits the displacement of the cam on an outer peripheral surface and is rotatably supported by a support part, and a sliding bearing mechanism is constituted between the sliding roller member and the support part.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention, wherein.

DETAILED DESCRIPTION OF THE INVENTION

Figure 1:
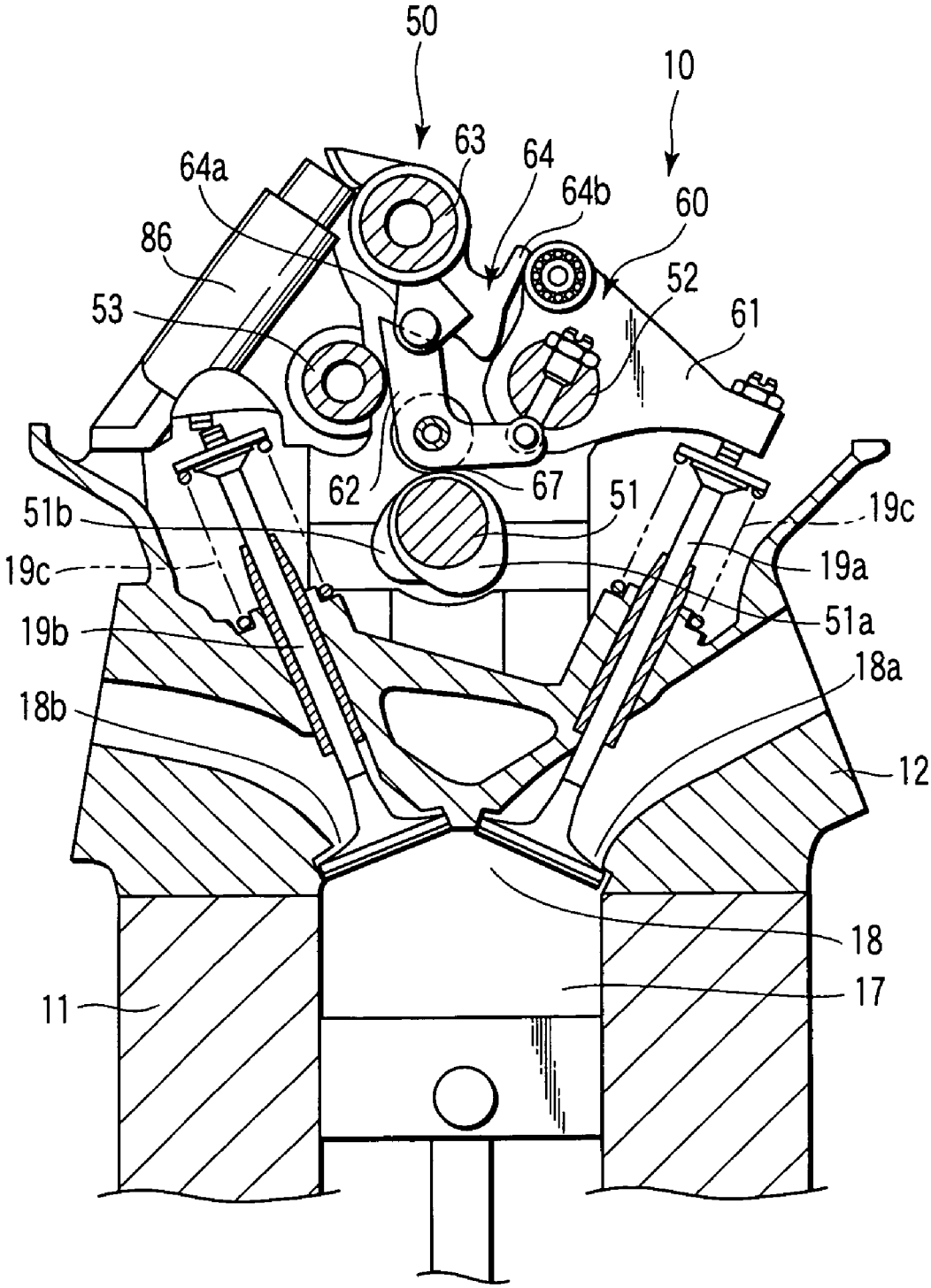
FIG. 1 is a cross-sectional view showing an engine provided with a variable valve mechanism according to a first embodiment of the invention.

A variable valve mechanism for an internal combustion engine according to a first embodiment of the invention will be described with reference to FIGS. 1 to 3. FIG. 1 is a cross-sectional view showing an engine 10 provided with a variable valve mechanism 50. As shown in FIG. 1, the engine 10 is, for example, a reciprocating engine having a plurality of cylinders arranged in series to each other. The engine 10 is provided with a cylinder block 11, a cylinder head 12, and the like.

A combustion chamber 18 is formed in the cylinder head 12 so as to correspond to a cylinder 17 formed in the cylinder block 11. The combustion chamber 18 has, for example, a pair of inlet ports 18*a* and a pair of exhaust ports 18*b*. The cylinder head 12 is provided with two inlet valves 19*a* for opening and closing each inlet port 18*a* and two exhaust valves 19*b* for opening and closing each exhaust port 18*b*. The inlet valve 19*a* and the exhaust valve 19*b* are normally closed by being biased to a closing direction by a spring 19*c*.

The variable valve mechanism 50 is mounted on the opposite side of the cylinder block 11 in the cylinder head 12. In this embodiment, the variable valve mechanism 50 has a function, for example, for adjusting the opening and closing operations in the inlet valve 19*a*.

The variable valve mechanism 50 is provided with a camshaft 51, an inlet valve rocker shaft 52, and a rocker arm mechanism 60.

The camshaft 51 is provided at a position facing the combustion chamber 18. The camshaft 51 extends in a direction in which the cylinders are arranged, and is rotatably supported around an axial center line of the camshaft 51. A cam pulley (not shown) is attached to the front end of the camshaft 51. The cam pulley (not shown) is connected to a crank pulley attached to an end part of the crankshaft through a timing belt (not shown). Thereby, the rotation of the crankshaft is transmitted to the camshaft 51 through the timing belt so as to drive the camshaft 51.

An inlet valve cam 51*a* and an exhaust valve cam 51*b* are provided in the camshaft 51. The inlet valve cam 51*a* is a cam for driving the inlet valve 19*a*, while the exhaust valve cam 51*b* is a cam for driving the exhaust valve 19*b*.

The inlet valve rocker shaft 52 is disposed closer to the side of the inlet valve 19*a* than the camshaft 51. The inlet valve rocker shaft 52 extends to be parallel to the camshaft 51 to be rotatably supported around an axial center line of the inlet valve rocker shaft 52. An exhaust valve rocker shaft 53 is disposed at the opposite side of the inlet valve rocker shaft 52. The exhaust valve rocker shaft 53 extends to be parallel to the camshaft 51 to be supported so as not to rotate. An exhaust valve rocker arm (not shown) is provided in the exhaust valve rocker shaft 53. The exhaust valve rocker arm is driven by the exhaust valve cam 51*b* to thereby drive the exhaust valve 19*b*.

The rocker arm mechanism 60 is driven by the inlet valve cam 51*a*. FIG. 2 is an exploded perspective view showing the rocker arm mechanism 60. FIG. 3 is a cross-sectional view showing the rocker arm mechanism 60 cut in a direction crossing the camshaft 51 so as to pass between a pair of rocker arm pieces 61*a* to be described later. As shown in FIGS. 2 and 3, the rocker arm mechanism 60 is provided with an inlet valve rocker arm 61, a center rocker arm 62, a support shaft 63, a swing cam 64, and an electric motor 65. The electric motor 65 is depicted by the two dot chain line in FIG. 2.

The inlet valve rocker arm 61 is swingably supported by the inlet valve rocker shaft 52. The inlet valve rocker arm 61 is provided with the pair of rocker arm pieces 61*a* and a needle roller member 66. The pair of rocker arm pieces 61*a* transmits the displacement of the cam lift of the inlet valve cam 51*a* to the inlet valve 19*a*. These rocker arm pieces 61*a* are arranged with a fixed distance along the inlet valve rocker shaft 52, and swingably supported by the inlet valve rocker shaft 52.

Thus, the inlet valve rocker arm 61 has a bifurcated shape. Therefore, a part 52*a* of the inlet valve rocker shaft 52 is exposed from between each of the rocker arm pieces 61*a*. The needle roller member 66, which is in contact with the swing cam 64 to be described later, is assembled on between each of the rocker arm pieces 61*a*.

Figure 3:
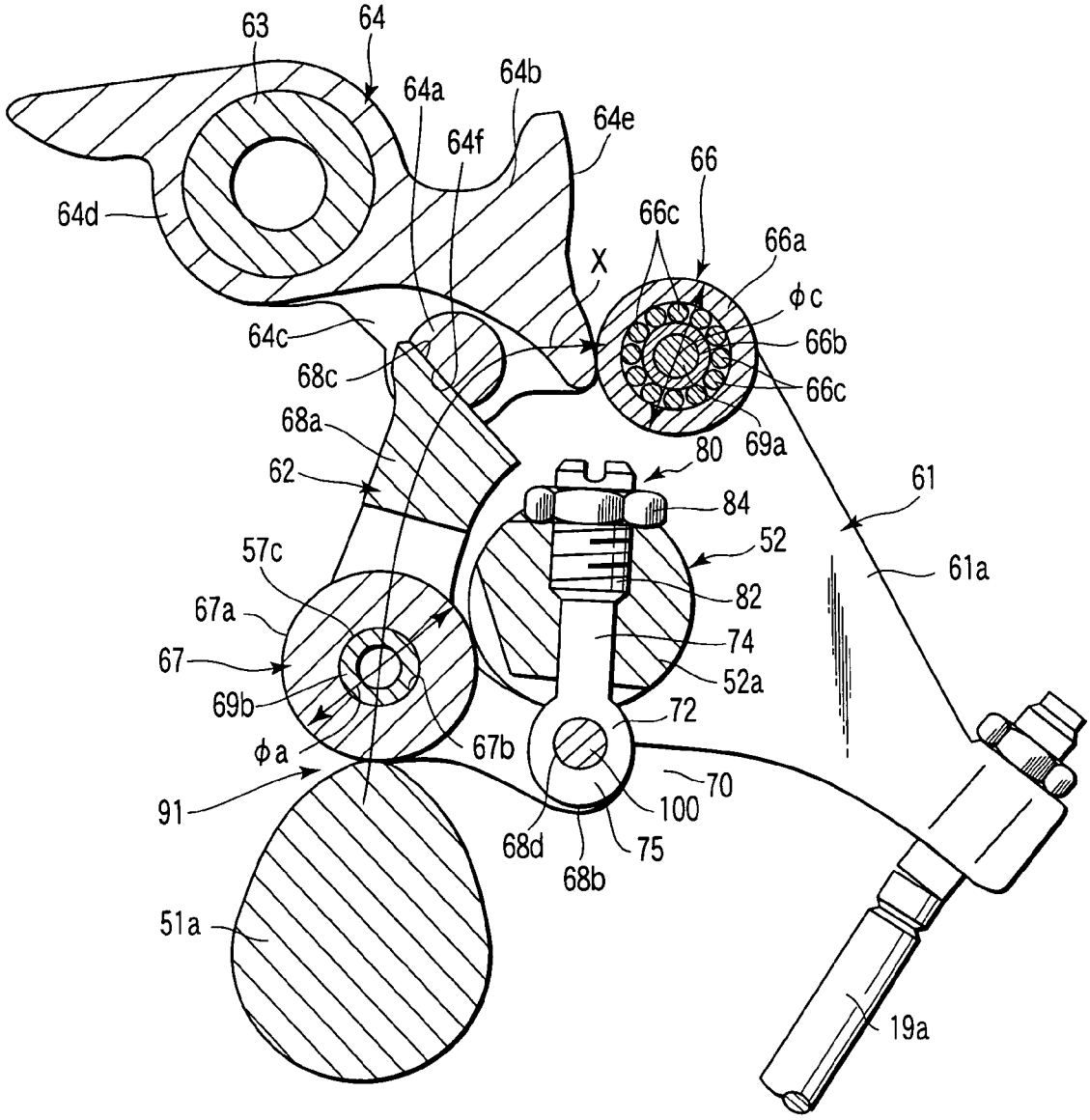
FIG. 3 is a cross-sectional view showing a transmission mechanism shown in FIG. 1 cut in a direction crossing a camshaft so as to pass between a pair of rocker arm pieces.

As shown in FIG. 3, the needle roller member 66 is an example of a rolling roller member of this invention, and provided with an outer ring 66*a*, an inner ring 66*b* and a plurality of needles 66*c*. The inner ring 66*b* is accommodated in the inside of the outer ring 66*a* to be coaxial with the outer ring 66*a*. The needles 66*c* are accommodated between the outer ring 66*a* and the inner ring 66*b*. The needle 66*c* is an example of a rolling element of this invention. Shapes of sections of the outer ling 66*a* and inner ling 66*b* are circle.

A first support axis 69*a* fitted in the inside of the inner ring 66*b* of the needle roller member 66 is provided between each of the rocker arm pieces 61*a*. Therefore, the inner ring 66*b* is fixed to the inlet valve rocker arm 61, while the outer ring 66*a* is rendered rotatable about the inner ring 66*b* by the plurality of the needles 66*c*.

Figure 2:
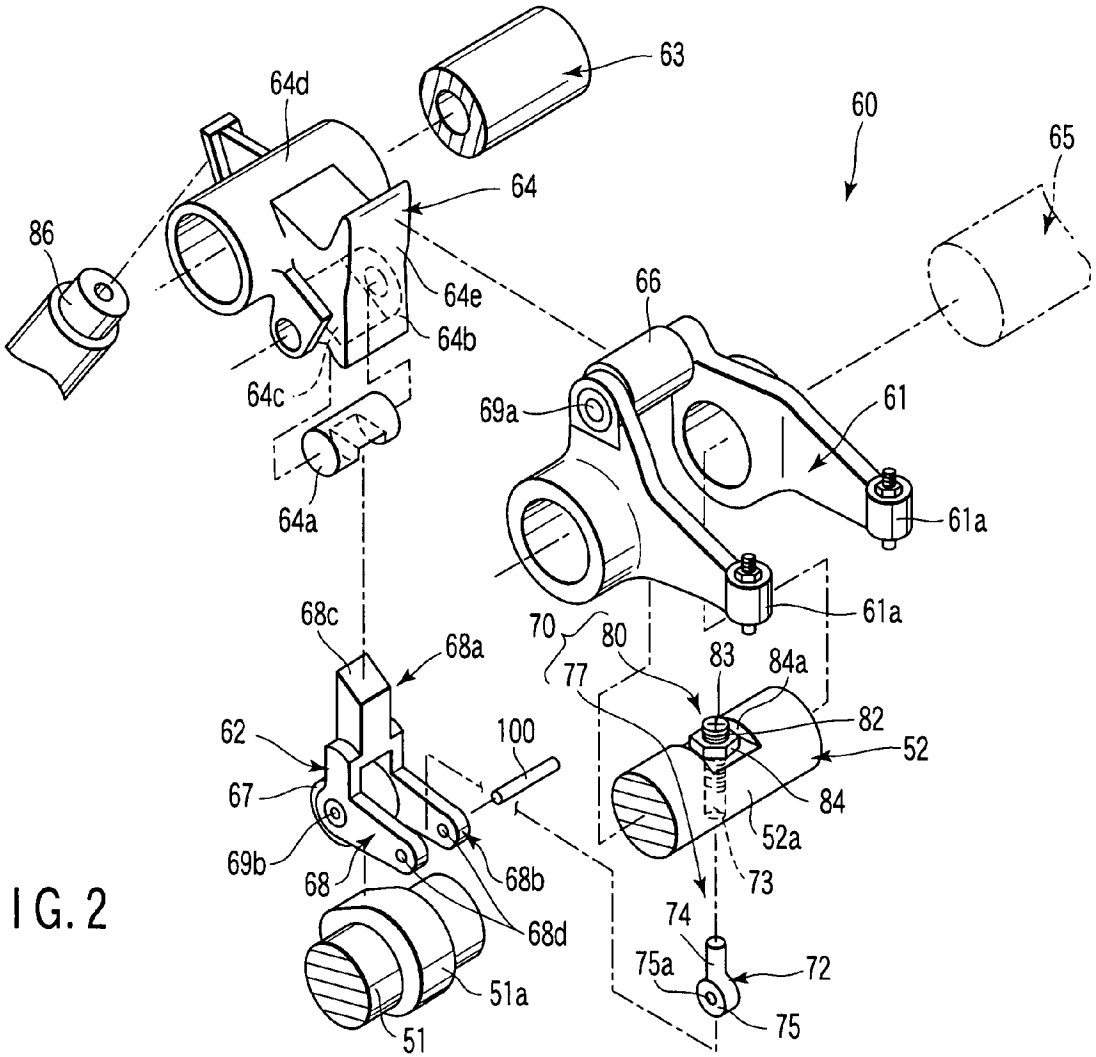
FIG. 2 is an exploded perspective view showing a rocker arm mechanism shown in FIG. 1.

As shown in FIG. 2, the center rocker arm 62 is provided with a holder part 68, a second support axis 69*b*, and a first sliding roller member 67. The center rocker arm 62 is an example of a transmission member of this invention.

The holder part 68 rotatably supports the first sliding roller member 67 to be described later. The holder part 68 is provided with a relay arm part 68*a* and a fulcrum arm part 68*b*, and formed into an approximately L-like shape. The relay arm part 68*a* extends toward the opposite side of the cylinder block 11, while the fulcrum arm part 68*b* extends toward the part 52*a* exposed from between each of the rocker arm pieces 61*a*, and has a bifurcated shape.

The second support axis 69*b* is provided between a part where the center rocker arm 62 and the inlet valve cam 51*a* are faced to each other, that is, between a part where the bifurcated fulcrum arm part 68*b* and the inlet valve cam 51*a* are faced to each other.

The first sliding roller member 67 is supported by the second support axis 69*b*. Specifically, an accommodation hole 57*c* for slidably accommodating the second support axis in its inside is formed at the center of the first sliding roller member 67. A shape of section of the first sliding roller member 67 is circle.

Therefore, the first sliding roller member 67 is rotatably supported by the second support axis 69*b*. The first sliding roller member 67 is solid from an outer peripheral surface 67*a* in contact with the inlet valve cam 51*a* to an inner peripheral surface 67*b* accommodating the second support axis 69*b* in its inside. The inner peripheral surface 67*b* is in substantial surface contact with the second support axis 69*b*. A diameter $\phi a$ of the first sliding roller member 67 is larger then a diameter $\phi c$ of the needle roller member 66.

The second support axis 69*b* is an example of a support part of this invention. The inner peripheral surface 67*b* and the second support axis 69*b* constitute a sliding bearing mechanism of this invention. A part of the inlet valve cam 51*a* contacting with the first sliding roller member 67 and the first sliding roller member 67 constitute a first transmission part 91 of this invention. Namely, the first transmission part 91 is provided with the first sliding roller member 67.

The fulcrum arm part 68*b* is supported by the exposed part 52*a* in a support mechanism 70. As shown in FIG. 2, the support mechanism 70 is provided with a support part 77 and an adjusting part 80. The support part 77 will be described as follows. The support part 77 is provided with a control arm 72. A through hole 73 is formed in a lower peripheral wall of the exposed part 52*a*. The through hole 73 extends to a direction perpendicular to the axial center of the exposed part 52*a*. The control arm 72 has an axis part 74 having a circular cross-sectional surface and a disk-like pin connecting piece 75 formed at one end of the axis part 74. The pin connecting piece 75 has a support hole 75*a* penetrating through the pin connecting piece 75.

The end part of the axis part 74 is inserted into the through hole 73 from the lower part of the exposed part 52*a*. The inserted axis part 74 is movable to the axial and peripheral directions thereof. The end of the axis part 74 is collided with an after-mentioned screw member 82 of the adjusting part 80.

The pin connecting piece 75 is inserted in the inside of the bifurcated fulcrum arm part 68*b*. The fulcrum arm part 68*b* has through-holes 68*d* formed to face the support hole 75*a*. A pin 100 is inserted through the support hole 75*a* and the through-holes 68*d*, so that the front ends of the fulcrum arm part 68*b* and the end part of the control arm 72 protruded from the exposed part 52*a* are rotatably connected with each other in an undulating direction of the inlet valve cam 51*a*, that is, in a direction perpendicular to the axial center of the camshaft 51.

The inlet valve cam 51*a* is rotated by the connection of the front ends of the fulcrum arm part 68*b* and the end part of the control arm 72, whereby the center rocker arm 62 is swung around the pin 100 as the swing shaft. Therefore, the posture of the center rocker arm 62 is changed following the rotation of the inlet valve rocker shaft 52. The first sliding roller member 67 receives the displacement of the cam lift of the inlet valve cam 51*a* to change the position and posture of the front end surface 68*c* of the relay arm part 68*a*.

In the constitution of the adjusting part 80, the end of the inserted control arm 72 is supported with the screw member 82. Specifically, the screw member 82 is threadedly inserted in a retractable manner from the opposite side of the through hole 73, that is, from the upper peripheral wall in the exposed part 52*a*. The inserting end of the screw member 82 is collided with the end of the control arm 72 in the through hole 73, whereby the control arm 72 is supported.

Thereby, when the screw member 82 is operated to be rotated, the projection amount of the axis part 74 protruding from the exposed part 52*a* is changed. Namely, the projection amount of the axis part 74 becomes variable. The projection amount of the axis part 74 is changed, and thus the rotational contact part between the inlet valve cam 51*a* and the first sliding roller member 67 is changed, whereby the periods of opening and closing the inlet valve 19*a* are adjusted.

Note that, reference numeral 83 is, for example, a cruciform groove part formed on the upper end surface of the screw member 82 for use in the rotating operation of the screw member 82. Reference numeral 84 is a lock nut screwed in the end part of the screw member 82. Reference numeral 84*a* represents a cut-out part forming a seating surface of the rock nut 84. In FIG. 3, the control arm 72, the screw member 82, and the lock nut 84 are not cross-sectioned.

As shown in FIG. 1, a support shaft 63 is provided farther from the cylinder block 11 than the inlet valve rocker shaft 52 and the exhaust valve rocker shaft 53.

As shown in FIGS. 2 and 3, the swing cam 64 is provided with a main body 64*d* and a displacement receiving shaft 64*a* having a contact surface 64*f* which comes into slidable contact with the front end surface 68*c* of the relay arm part 68*a* of the center rocker arm 62. The main body 64*d* is swingably supported by the support shaft 63.

An accommodation groove 64*c*, which opens toward the front end surface 68*c* of the relay arm part 68*a* and accommodates the displacement receiving shaft 64*a* in its inside, is formed in the main body 64*d* so as to face the front end surface 68*c*. The displacement receiving shaft 64*a* is swingably accommodated in the accommodation groove 64*c*.

Both the main body 64*d* and the displacement receiving shaft 64*a* are swingable, so that the displacement receiving shaft 64*a* can follow the change in the posture of the front end surface 68*c* of the relay arm part 68*a* following the change in the posture of the center rocker arm 62.

An arm part 64*b* contacting with the needle roller member 66 is formed in the main body 64*d* so as to face the needle roller member 66. A cam surface 64*e* in rolling contact with the needle roller member 66 is formed at the front end of the arm part 64*b*.

When the displacement receiving shaft 64*a* receives the displacement of the center rocker arm 62, the swing cam 64 is swung around the support shaft 63. At this time, the cam surface 64*e* of the arm part 64*b* pushes the needle roller member 66.

The inlet valve rocker arm 61, the center rocker arm 62, and the swing cam 64 are biased in a direction to be closely contacted with each other by a pusher 86 as an example of a bias mechanism so that their smooth movement is ensured.

The electric motor 65 rotates the inlet valve rocker shaft 52, to thereby change the position of the support part 77 (the posture of the control arm 72) supporting the fulcrum arm part 68*b* of the center rocker arm 62 in the inlet valve rocker shaft 52. The posture of the center rocker arm 62 is changed following the change of the position of the support part 77.

The posture of the center rocker arm 62 can be changed in a range from the posture in which the control arm 72 is approximately vertical as shown in FIG. 3 to the posture in which the control arm 72 is substantially tilted in the rotating direction of the camshaft 51 as shown in FIG. 1.

When the posture of the center rocker arm 62 is changed, the degree of the displacement of the cam lift of the inlet valve cam 51*a* to be transmitted to the swing cam 64 is changed. As a result, the posture and swinging in the swing cam 64 are changed, and thus, the movement of the inlet valve rocker arm 61 is changed. The posture of the inlet valve rocker shaft 52 is adjusted by the electric motor 65, whereby the operation of the inlet valve 19*a* is adjusted.

The displacement of the inlet valve cam 51*a* in the variable valve mechanism 50 constituted as above and the load transmitting this displacement are transmitted in the order of the inlet valve cam 51*a*, the center rocker arm 62, the swing cam 64, and the inlet valve rocker arm 61. This transmission path X will be specifically described hereinafter.

The first sliding roller member 67 first receives the load due to the displacement of the inlet valve cam 51*a* because the first sliding roller member 67 is in contact with the inlet valve cam 51*a*. The center rocker arm 62 is displaced according to the displacement of the inlet valve cam 51*a* in response to the load applied to the first sliding roller member 67. The load is transmitted from the front end surface 68*c* to the contact surface 64*f* of the displacement receiving shaft 64*a* because of the displacement of the center rocker arm 62.

The swing cam 64 is swung around the support shaft 63 by the load applied to the swing cam 64. The load is then applied to the needle roller member 66 from the cam surface 64*e* by the swinging of the swing cam 64. The inlet valve rocker arm 61 is displaced by the application of the load to the needle roller member 66. The inlet valve 19*a* is open or closed by the displacement of the inlet valve rocker arm 61.

In the variable valve mechanism 50 constituted as above, the first transmission part 91 is provided relatively far from the inlet valve 19*a* in the transmission path X. Therefore, the load acting on the first transmission part 91 has a sufficient size for moving the center rocker arm 62, the swing cam 64, the inlet valve rocker arm 61, and the inlet valve 19*a*.

However, the first sidling roller member 67 is provided in the first transmission part 91. The first sliding roller member 67 is solid from the outer peripheral surface 67*a* to the inner peripheral surface 67*b*, and thus has a high rigidity. Further, the load applied to the outer peripheral surface 67*a* is dispersed in a surface part at which the inner peripheral surface 67*b* and the second support axis 69*b* come into surface contact with each other.

Therefore, the deformation of the first sliding roller member 67 due to the load can be reduced. Further, the friction between the inlet valve cam 51*a* and the center rocker arm 62 can be reduced by using the first sliding roller member 67 in the first transmission part 91.

Meanwhile, the contact part between the swing cam 64 and the inlet valve rocker arm 61 in the transmission path X is positioned immediately in front of the inlet valve 19*a*. Therefore, the load acting on this contact part in the transmission path X is relatively small. Accordingly, even when the needle roller member 66 is provided in this contact part in the transmission path X, the deformation of the needle roller member 66 due to the load can be reduced. Further, the friction between the swing cam 64 and the inlet valve rocker arm 61 can be reduced by using the needle roller member 66.

According to the above embodiment, the deformations of the first transmission part 91 and the contact part between the swing cam 64 and the inlet valve rocker arm 61 in the transmission path X can be reduced, so that the transmission loss of the displacement of the inlet valve cam 51*a* can be reduced when the displacement of the inlet valve cam 51*a* is transmitted through the transmission path X. Further, the friction generated in the transmission path X can be reduced by using the first sliding roller member 67 and the needle roller member 66. Namely, the variable valve mechanism 50 can suppress the transmission loss of the displacement of the inlet valve cam 51*a* while reducing the friction.

When the diameter $\phi a$ of the first sliding roller member 67 is rendered the same as the diameter $\phi c$ of the needle roller member 66, the difference in the rigidity of them is generated, depending on the type of the roller, that is, the sliding roller and the needle roller. However, when the diameter $\phi a$ is rendered larger than the diameter $\phi c$, the rigidity of the first sliding roller member 67 can be enhanced all the more depending on the size of the roller.

In this embodiment, the diameter $\phi a$ of the first sliding roller member 67 may be same as the diameter $\phi c$ of the needle roller member 66.

Next, a variable valve mechanism according to the second embodiment of this invention will be described with reference to FIG. 4. The description of the constitution having the same function as the first embodiment is omitted by representing the components by the same numbers. In the second embodiment, the swing cam 64 is provided with a second sliding roller member 90 instead of the displacement receiving shaft 64*a*. This difference from the first embodiment will be specifically explained hereinafter. The other constitution may be the same as the first embodiment.

Figure 4:
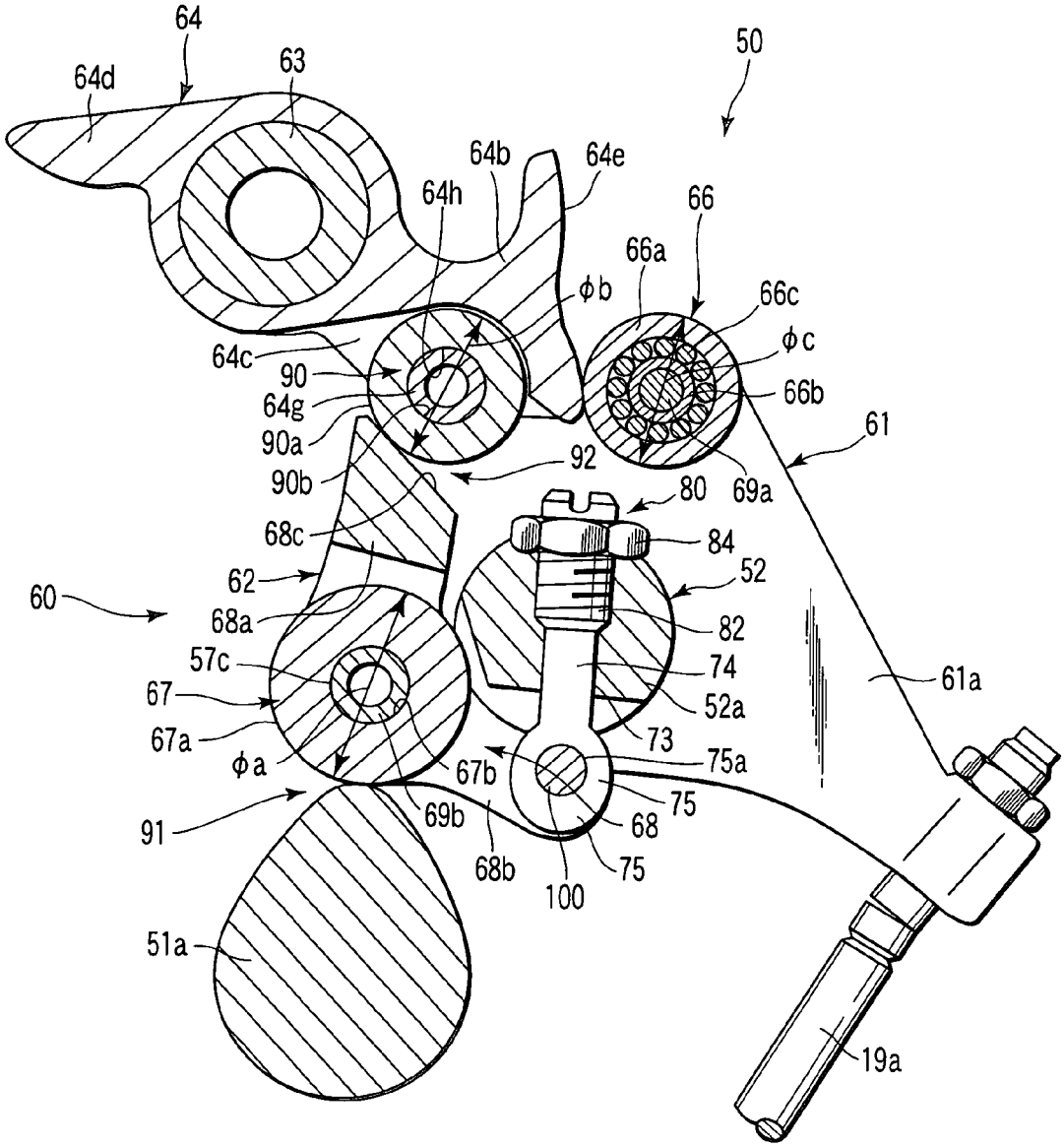
FIG. 4 is a cross-sectional view showing a transmission mechanism of a variable valve mechanism according to a second embodiment of the invention cut in a direction crossing a camshaft so as to pass between a pair of rocker arm pieces.

FIG. 4 is a cross-sectional view showing the rocker arm mechanism 60 of this embodiment cut in a direction crossing the camshaft 51 so as to pass between the pair of the rocker arm pieces 61*a*. As shown in FIG. 4, the swing cam 64 is provided with the second sliding roller member 90 instead of the displacement receiving shaft 64*a*. A shape of section of the second roller member 90 is circle.

Specifically, a third support axis 64*g* is provided in the accommodation groove 64*c* of the main body 64*d*. An accommodation hole 64*h* for slidably accommodating the third support axis 64*g* in its inside is formed on the axial center of the second sliding roller member 90. Namely, the second sliding roller member 90 is rotatably supported by the third support axis 64*g*. The third support axis 64*g* is an example of a support part of this invention.

An outer peripheral surface 90*a* of the second sliding roller member 90 comes into point contact with the front end surface 68*c*. An inner peripheral surface 90*b* of the second sliding roller member 90 is in substantial surface contact with the third support axis 64*g*. The inner peripheral surface 90*b* and the third support axis 64*g* constitute a sliding bearing mechanism of this invention. The front end surface 68*c* and the second sliding roller member 90 constitute a second transmission part 92 of this invention. Namely, the second transmission part 92 is provided with the second sliding roller member 90.

The second sliding roller member 90 is solid from the outer peripheral surface 90*a* to the inner peripheral surface 90*b*. A diameter $\phi b$ of the second sliding roller member 90 is larger than the diameter $\phi c$ of the needle roller member 66, and smaller than the diameter $\phi a$ of the first sliding roller member 67.

In this embodiment, the friction in the second transmission part 92 can be reduced by using the second sliding roller member 90, so that the friction generated in the transmission path X can be reduced in addition to the effect obtained in the first embodiment.

In addition, since the diameter $\phi b$ of the second sliding roller member 90 is larger than the diameter $\phi c$ of the needle roller member 66, the rigidity of the second sliding roller member 90 can be rendered larger than that of the needle roller member 66. Therefore, the deformation in the second transmission part 92 can be reduced, so that the transmission loss of the displacement of the inlet valve cam 51*a* can be reduced.

Figure 5:
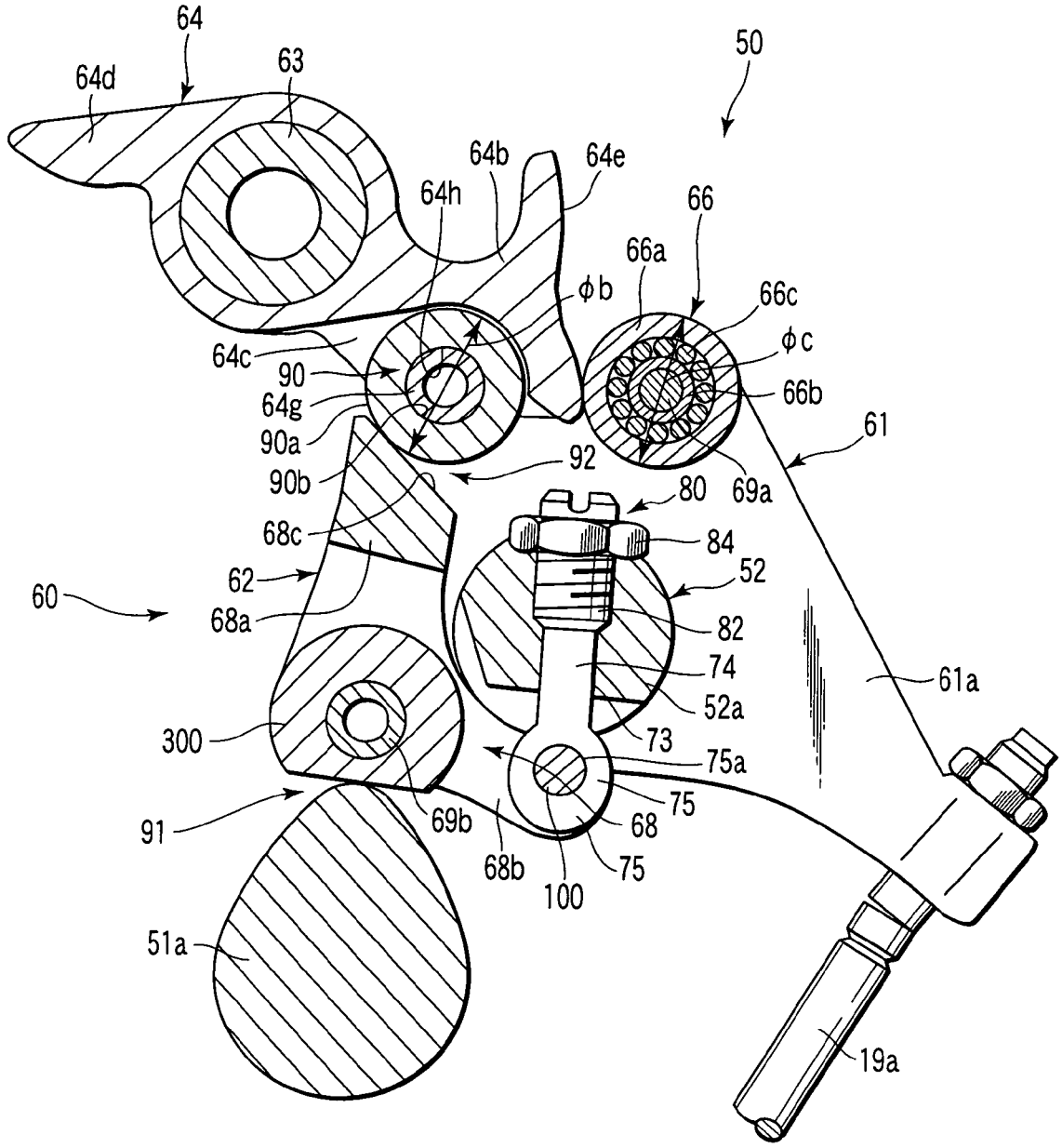
FIG. 5 is a cross-sectional view showing variable valve mechanism in which the first transmission part is provided with a displacement receiving shaft coming into slidable contact with the inlet valve cam.

In the first embodiment, the first transmission part 91 is provided with the first sliding roller member 67, and the second transmission part 92 is provided with the sliding bearing mechanism constituted of the front end surface 68*c* and the contact surface 64*f*; however, this invention is not limited to such a constitution. For instance, as shown in FIG. 5, the first transmission part 91 may be provided with a displacement receiving shaft 300 coming into slidable contact with the inlet valve cam 51*a*, while the second transmission part 92 may be provided with the second sliding roller member 90 described in the second embodiment.

In addition, in the second embodiment, although the diameters $\phi a$, $\phi b$ and $\phi c$ satisfy the condition: $\phi c<\phi b<\phi a$, this invention is not limited to this condition. Even when $\phi c \leqq \phi b<\phi a$, the similar effect can be obtained. Specifically, the difference in rigidity between the sliding roller and the needle roller is generated depending on the type of the roller only by rendering the diameter $\phi b$ of the second sliding roller member 90 the same as the diameter ϕc of the needle roller member 66. However, the diameter ϕa of the second sliding roller member 90 is rendered larger than the diameter ϕc of the needle roller member 66, whereby the rigidity of the second sliding roller member 90 can be enhanced all the more based on the size of the roller. Further, it is possible to further increase the rigidity of the first sliding roller member 67 used for the first transmission part 91 to which the larger load is applied than the second transmission part 92.

Figure 6:
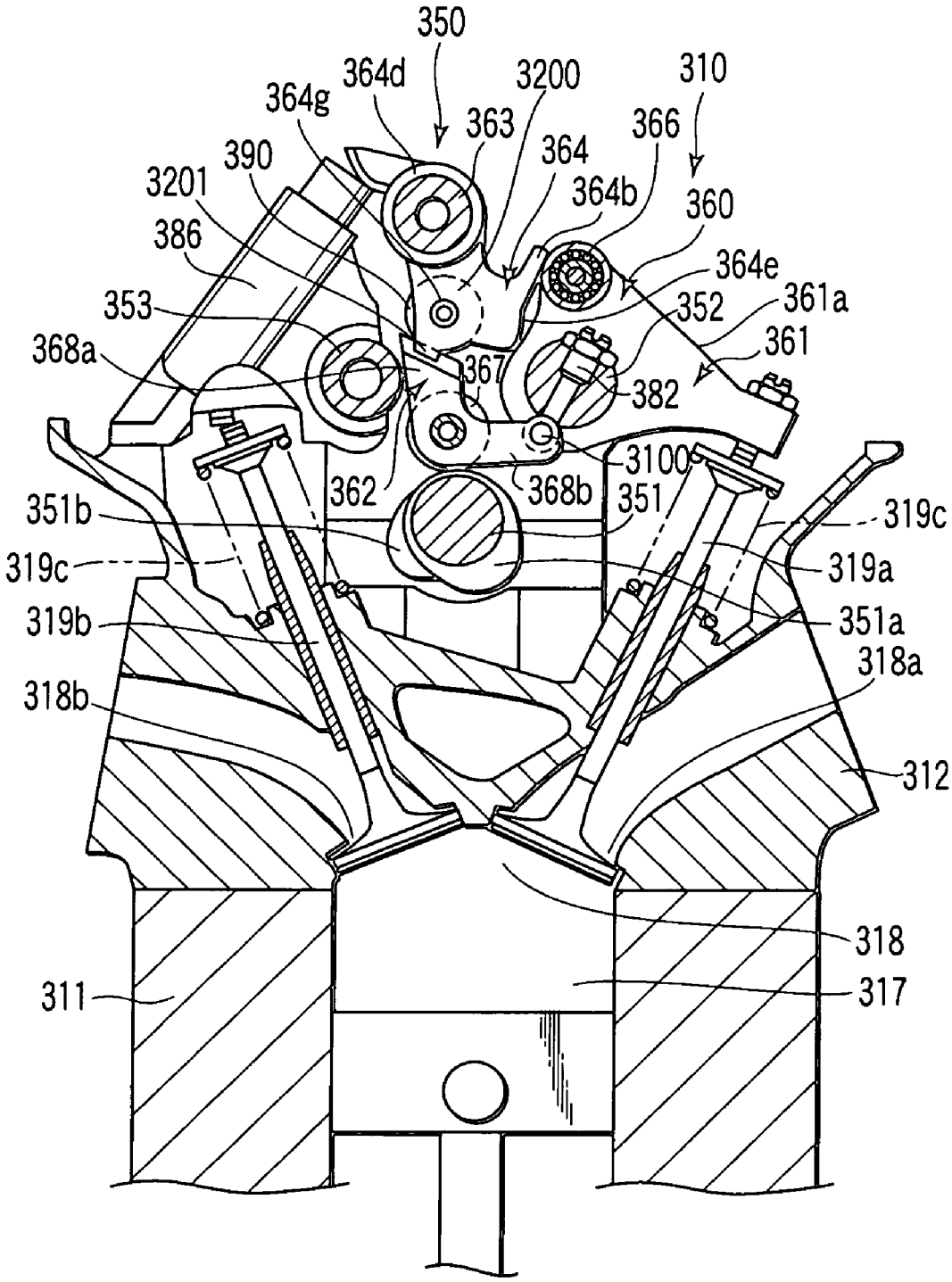
FIG. 6 is a cross-sectional view showing an engine provided with a variable valve mechanism according to a third embodiment of the invention.

A variable valve mechanism for an internal combustion engine according to the third embodiment of this invention will be described with reference to FIGS. 6 to 10. FIG. 6 is a cross-sectional view showing an engine 310 provided with a variable valve mechanism 350. As shown in FIG. 6, the engine 310 is, for example, a reciprocating engine having a plurality of cylinders arranged in series to each other. The engine 310 is provided with a cylinder block 311, a cylinder head 312, and the like.

A combustion chamber 318 is formed in the cylinder head 312 so as to correspond to a cylinder 317 formed in the cylinder block 311. The combustion chamber 318 has, for example, a pair of inlet ports 318*a* and a pair of exhaust ports 318*b*. The cylinder head 312 is provided with inlet valves 319*a* for opening and closing each inlet port 318*a* and exhaust valves 319*b* for opening and closing each exhaust port 318*b*. The inlet valve 319*a* and the exhaust valve 319*b* are normally closed by being biased to a closing direction by a spring 319*c*.

The variable valve mechanism 350 is mounted on the opposite side of the cylinder block 311 in the cylinder head 312. In this embodiment, the variable valve mechanism 350 has a function, for example, for adjusting the opening and closing operations in the inlet valve 319*a*.

The variable valve mechanism 350 is provided with a camshaft 351, an inlet valve rocker shaft 352, and a rocker arm mechanism 360.

The camshaft 351 is provided at a position facing the combustion chamber 318. The camshaft 351 extends in a direction in which the cylinders are arranged, and is rotatably supported around an axial center line of the camshaft 351. A cam pulley (not shown) is attached to the front end of the camshaft 351. The cam pulley is connected to a crank pulley attached to an end part of a crankshaft (not shown) through a timing belt (not shown). Thereby, the rotation of the crankshaft is transmitted to the camshaft through the timing belt so as to drive the camshaft 351.

An inlet valve cam 351*a* and an exhaust valve cam 351*b* are provided in the camshaft 351. The inlet valve cam 351*a* is a cam for driving the inlet valve 319*a*. The inlet valve cam 351*a* is an example of a rotation cam of the invention. The inlet valve 319*a* is an example of a valve of the invention. The exhaust valve cam 351*b* is a cam for driving the exhaust valve 319*b*.

An inlet valve rocker shaft 352 is disposed closer to the side of the inlet valve 319*a* than the camshaft 351. The inlet valve rocker shaft 352 extends to be parallel to the camshaft 351 to be rotatably supported around an axial center line of the inlet valve rocker shaft 352. An exhaust valve rocker shaft 353 is disposed at the opposite side of the inlet valve rocker shaft 352. The exhaust valve rocker shaft 353 extends to be parallel to the camshaft 351 to be supported so as not to rotate. An exhaust valve rocker arm (not shown) is provided in the exhaust valve rocker shaft 353. The exhaust valve rocker arm is driven by the exhaust valve cam 351*b* to drive the exhaust valve 319*b*.

Figure 7:
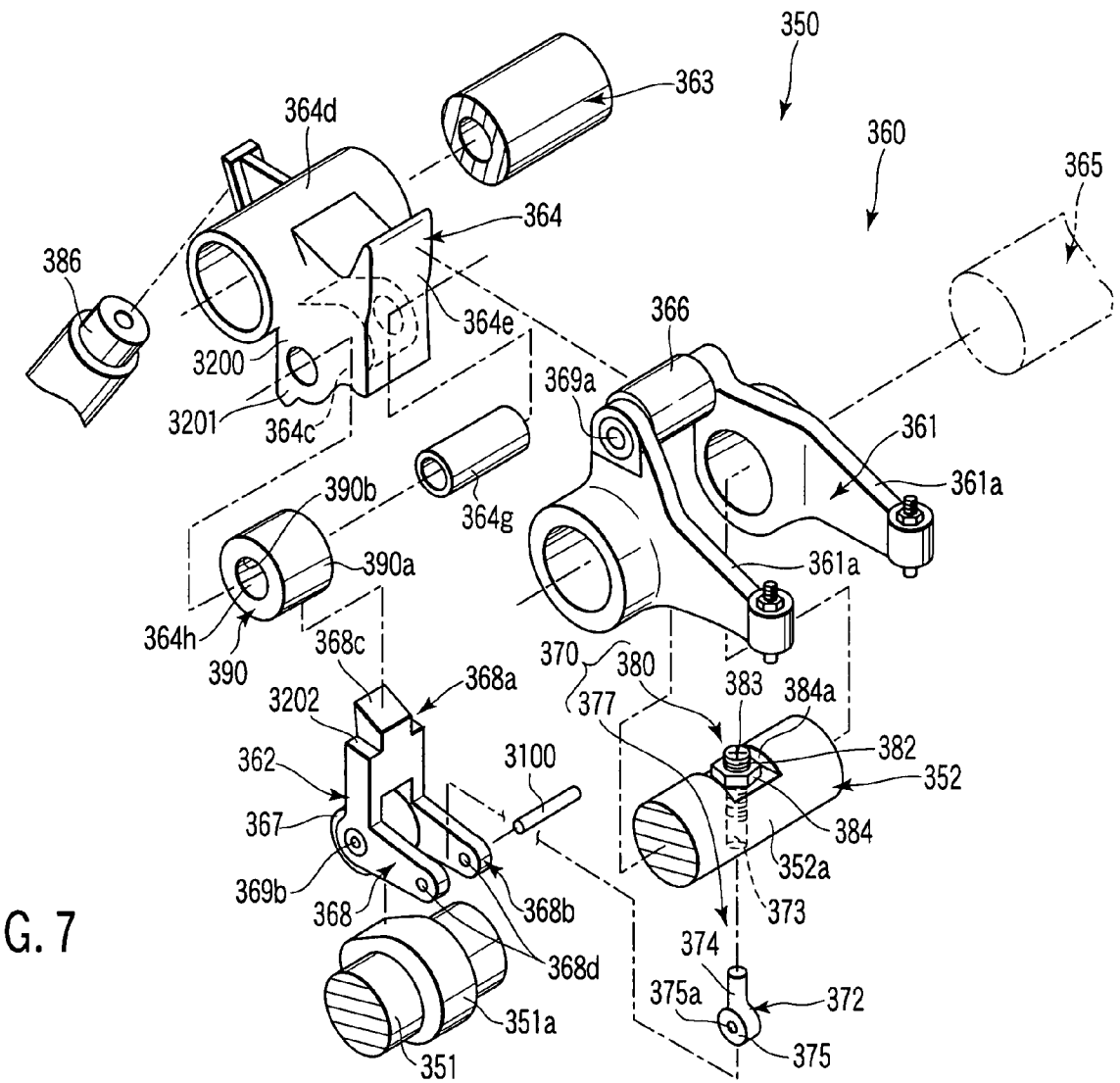
FIG. 7 is an exploded perspective view showing a rocker arm mechanism shown in FIG. 6.
Figure 8:
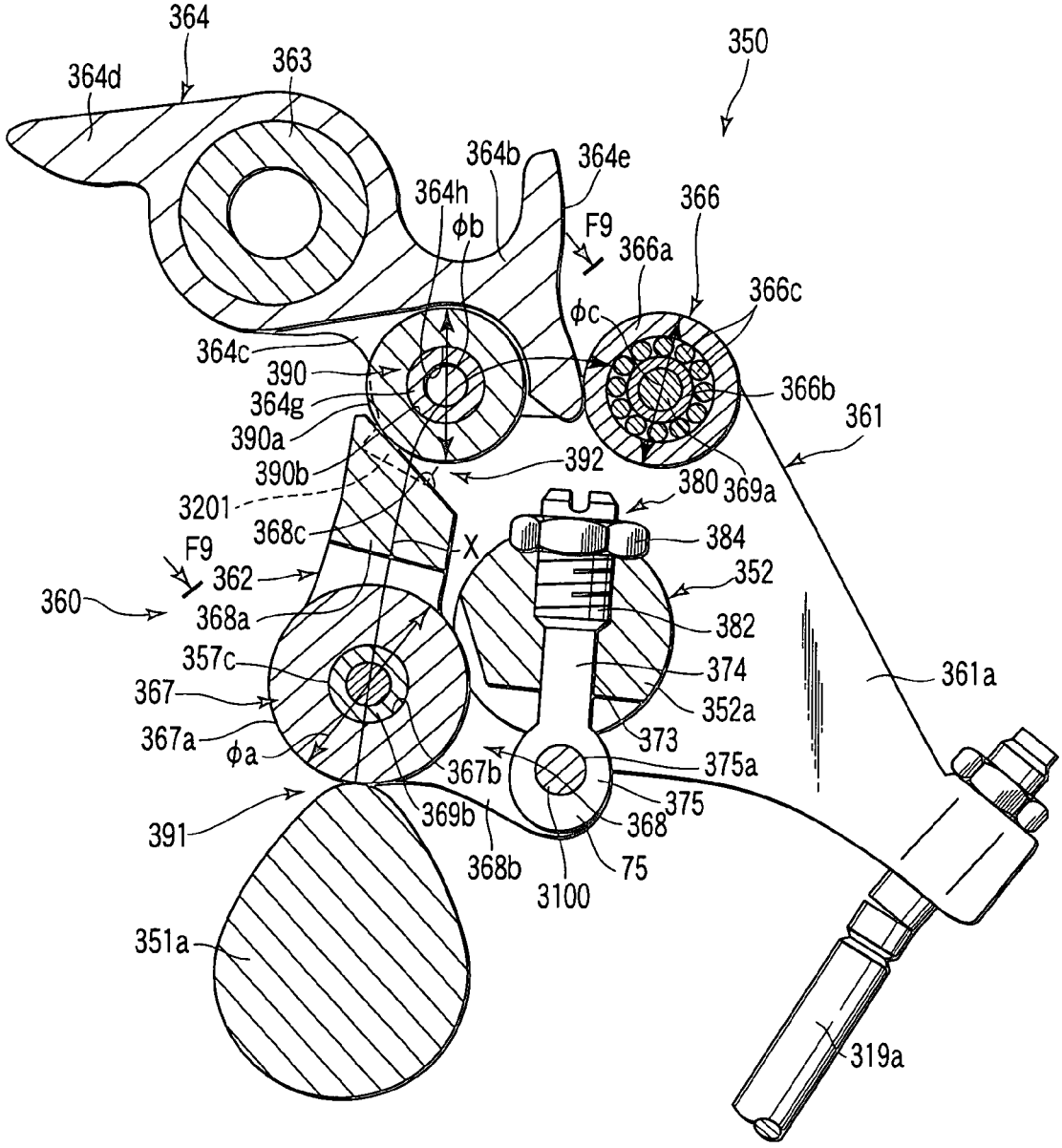
FIG. 8 is a cross-sectional view showing a transmission mechanism shown in FIG. 6 cut in a direction crossing a camshaft so as to pass between a pair of rocker arm pieces.

The rocker arm mechanism 360 is driven by the inlet valve cam 351*a*. FIG. 7 is an exploded perspective view showing the rocker arm mechanism 360. FIG. 8 is a cross-sectional view showing the rocker arm mechanism 360 cut in a direction crossing the camshaft 351 so as to pass between a pair of rocker arm pieces 361*a* to be described later. As shown in FIGS. 7 and 8, the rocker arm mechanism 360 is provided with an inlet valve rocker arm 361, a center rocker arm 362, a support shaft 363, a swing cam 364, and an electric motor 365. The electric motor 365 is depicted by the two dot chain line in FIG. 6.

The inlet valve rocker arm 361 is swingably supported by the inlet valve rocker shaft 352. The inlet valve rocker arm 361 is provided with the pair of rocker arm pieces 361*a* and a needle roller member 366. The pair of rocker arm pieces 361*a* transmits the displacement of the cam lift of the inlet valve cam 351*a* to the inlet valve 319*a*. These rocker arm pieces 361*a* are arranged with a fixed distance along the inlet valve rocker shaft 352, and swingably supported by the inlet valve rocker shaft 352.

Thus, the inlet valve rocker arm 361 has a bifurcated shape. Therefore, a part 352*a* of the inlet valve rocker shaft 352 is exposed from between each of the rocker arm pieces 361*a*. The needle roller member 366, which is in contact with the swing cam 364 to be described later, is assembled on between each of the rocker arm pieces 361*a*.

As shown in FIG. 8, the needle roller member 366 is provided with an outer ring 366*a*, an inner ring 366*b* and a plurality of needles 366*c*. The inner ring 366*b* is accommodated in the inside of the outer ring 366*a* to be coaxial with the outer ring 366*a*. The needles 366*c* are accommodated between the outer ring 366*a* and the inner ring 366*b*.

A first support axis 369*a* fitted in the inside of the inner ring 366*b* of the needle roller member 366 is provided between each of the rocker arm pieces 361*a*. Therefore, the inner ring 366*b* is fixed to the inlet valve rocker arm 361, while the outer ring 366*a* is rendered rotatable about the inner ring 366*b* by the plurality of needles 366*c*. Shapes of section of the outer ring 366*a* and the inner ring 366*b* are circle.

As shown in FIG. 7, the center rocker arm 362 is provided with a holder part 368, a second support axis 369*b*, and a first sliding roller member 367. The center rocker arm 362 is an example of a transmission member of this invention.

The holder part 368 rotatably supports the first sliding roller member 367. The holder part 368 is provided with a relay arm part 368*a* and a fulcrum arm part 368*b*, and formed into an approximately L-like shape. The relay arm part 368*a* extends toward the opposite side of the cylinder block 311, while the fulcrum arm part 368*b* extends toward the part 352*a* exposed from between each of the rocker arm pieces 361*a*, and has a bifurcated shape.

The second support axis 369*b* is provided between a part where the center rocker arm 362 and the inlet valve cam 351*a* are faced to each other, that is, between a part where the bifurcated fulcrum arm part 368*b* and the inlet valve cam 351*a* are faced to each other.

The first sliding roller member 367 is supported by the second support axis 369*b*. Specifically, an accommodation hole 357*c* for slidably accommodating the second support axis 369*b* in its inside is formed at the center of the first sliding roller member 367.

Therefore, the first sliding roller member 367 is rotatably supported by the second support axis 369*b*. The first sliding roller member 367 is solid from an outer peripheral surface 367*a* in contact with the inlet valve cam 351*a* to an inner peripheral surface 367*b* accommodating the second support axis 369*b* in its inside. The inner peripheral surface 367*b* is in substantial surface contact with the second support axis 369*b*. A shape of section of the first sliding roller member 367 is circle.

The fulcrum arm part 368*b* is supported by the exposed part 352*a* in a support mechanism 370. As shown in FIG. 7, the support mechanism 370 is provided with a support part 377 and an adjusting part 380.

The support part 377 is provided with a control arm 372. A through hole 373 is formed in a lower peripheral wall of the exposed part 352*a*. The through hole 373 extends to a direction perpendicular to the axial center of the exposed part 352*a*. The control arm 372 has an axis part 374 having a circular cross-sectional surface and a disk-like pin connecting piece 375 formed at one end of the axis part 374. The pin connecting piece 375 has a support hole 375*a* penetrating through the pin connecting piece 375.

The end part of the axis part 374 is inserted in the through hole 373 from the lower part of the exposed part 352*a*. The inserted axis part 374 is movable to the axial and peripheral directions thereof. The end of the axis part 374 is collided with an after-mentioned screw member 382 of the adjusting part 380.

The pin connecting piece 375 is inserted in the inside of the bifurcated fulcrum arm part 368*b*. The fulcrum arm part 368*b* has through-holes 368*d* formed to face the support hole 375*a*. A pin 3100 is inserted through the support hole 375*a* and the through-holes 368*d*, so that the front ends of the fulcrum arm part 368*b* and the end part of the control arm 372 protruded from the exposed part 352*a* are rotatably connected with each other in an undulating direction of the inlet valve cam 351*a*, that is, in a direction perpendicular to the axial center of the camshaft 351.

The inlet valve cam 351*a* is rotated by the connection of the front ends of the fulcrum arm part 368*b* and the end part of the control arm 372, whereby the center rocker arm 362 is swung around the pin 3100 as the swing shaft. Therefore, the posture of the center rocker arm 362 is changed following the rotation of the inlet valve rocker shaft 352. The first sliding roller member 367 receives the displacement of the cam lift of the inlet valve cam 351*a* to change the position and posture of the front end surface 368*c* of the relay arm part 368*a*.

In the constitution of the adjusting part 380, the end of the inserted control arm 372 is supported with the screw member 382. Specifically, the screw member 382 is threadedly inserted in a retractable manner from the opposite side of the through hole 373, that is, from the upper peripheral wall in the exposed part 352*a*. The inserting end of the screw member 382 is collided with the end of the control arm 372 in the through hole 373, whereby the control arm 372 is supported.

Thereby, when the screw member 382 is operated to be rotated, the projection amount of the axis part 374 protruding from the exposed part 352*a* is changed. Namely, the projection amount of the axis part 374 becomes variable. The projection amount of the axis part 374 is changed, and thus the rotational contact part between the inlet valve cam 351*a* and the first sliding roller member 367 is changed, whereby the periods of opening and closing the inlet valve 319*a* are adjusted.

Note that, reference numeral 383 is, for example, a cruciform groove part formed on the upper end surface of the screw member 382 for use in the rotating operation of the screw member 382. Reference numeral 384 is a lock nut screwed in the end part of the screw member 382. Reference numeral 384*a* represents a cut-out part forming a seating surface of the lock nut 384. In FIG. 8, the control arm 372, the screw member 382, and the lock nut 384 are not cross-sectioned.

As shown in FIG. 6, the support shaft 363 is provided farther from the cylinder block 311 than the inlet valve rocker shaft 352 and the exhaust valve rocker shaft 353. The support shaft 363 is in parallel to the camshaft 351.

As shown in FIGS. 7 and 8, the swing cam 364 is provided with a main body 364*d* and a second sliding roller member 390. The second sliding roller member 390 is an example of a roller member of this invention. A shape of section of the second roller member 390 is circle.

The main body 364*d* is swingably supported by the support shaft 363. An accommodation groove 364*c*, which opens toward the front end surface 368*c* of the relay arm part 368*a* and accommodates the second sliding roller member 390 in its inside, is formed in the main body 364*d* so as to face the front end surface 368*c*. The second sliding roller member 390 is swingably accommodated in the accommodation groove 364*c*.

Figure 9:
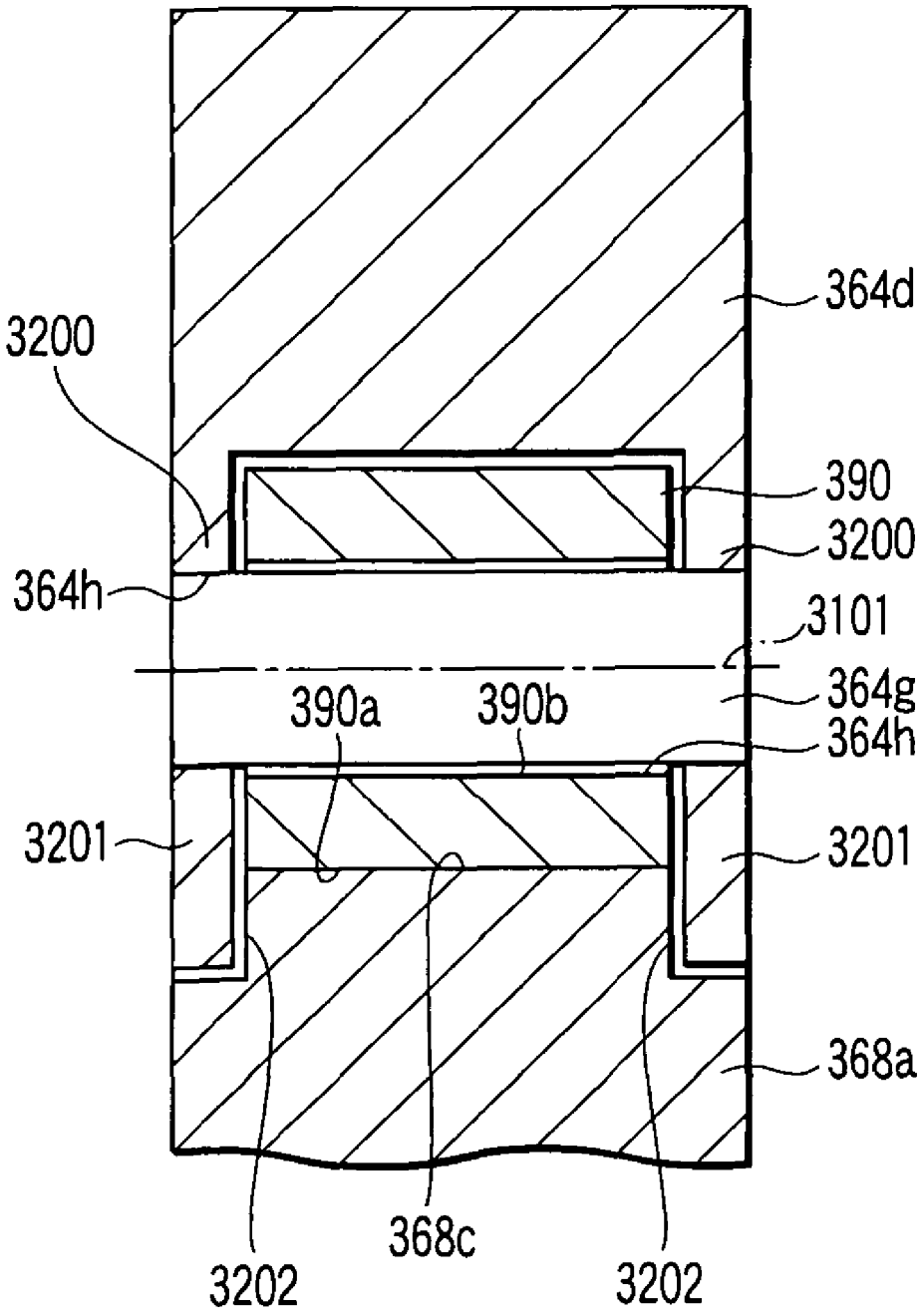
FIG. 9 is a cross-sectional view of the variable valve mechanism taken along F9-F9 line in FIG. 8.

Specifically, the third support axis 364*g* is provided in the accommodation groove 364*c* of the main body 364*d*. FIG. 9 is a cross-sectional view of the variable valve mechanism 350 taken along F9-F9 line in FIG. 8. FIG. 9 shows a part of the relay arm part 368*b* of the center rocker arm 362, the main body 364*d*, and the second sliding roller member 390.

As shown in FIGS. 8 and 9, the third support axis 364*g* extends from one to the other of a pair of support wall parts 3200 in the wall part specifying the accommodation groove 364*c*, and is supported by the support wall parts 3200. The support wall parts 3200 cross the axial center line direction of the pin 3100, and are faced to each other. An axial center line 3101 of the third support axis 364*g* is approximately parallel to the axial center line of the pin 3100. Therefore, the second sliding roller member 390 is rotated around a shaft parallel to the swing shaft (pin 3100) of the center rocker arm 362 as a rotation shaft.

An accommodation hole 364*h* for slidably accommodating the third support axis 364*g* in its inside is formed on the axial center of the second sliding roller member 390. Namely, the third support axis 364*g* is approximately fitted into the accommodation hole 364*h*, and thus the second sliding roller member 390 is rotatably supported by the third support axis 364*g*.

The outer peripheral surface 390*a* of the second sliding roller member 390 is in rolling contact with the front end surface 368*c*. The second sliding roller member 390 is solid from the outer peripheral surface 390*a* to the inner peripheral surface 390*b*.

The main body 364*d* is swingable, and at the same time, the second sliding roller member 390 is rotatable around the third support axis 364*g*, so that the second sliding roller member 390 can follow the change in the posture of the front end surface 368*c* of the relay arm part 368*a* following the change in the posture of the center rocker arm 362.

An arm part 364*b* contacting with the needle roller member 366 is formed in the main body 364*d* so as to face the needle roller member 366. A cam surface 364*e* in rolling contact with the needle roller member 366 is formed at the front end of the arm part 364*b*.

When the second sliding roller member 390 receives the displacement of the center rocker arm 362, the swing cam 364 is swung around the support shaft 363. At this time, the cam surface 364*e* of the arm part 364*b* pushes the needle roller member 366.

As shown in FIGS. 6 to 10, a guide part 3201 is formed in each of the support wall parts 3200. The guide part 3201 has a size covering the contact part between the second sliding roller member 390 and the front end surface 368*c* of the relay arm part 368*a*. Each of the guide parts 3201 is overlapped with the front end surface in the axial center line direction of the third support axis 364*g* to cover the contact part between the second sliding roller member 390 and the front end surface 368*c*.

The postures of the swing cam 364 and front end surface 368*c* are changed during the transmission of the displacement of the inlet valve cam 351*a*, whereby the contact part between the swing cam 364 and the front end surface 368*c* is changed.

As mentioned above, the guide part 3201 has a size sufficient for covering the assumed range in which the contact part between the second sliding roller member 390 and the front end surface 368*c* is changed. The guide part 3201 formed in each of the support wall parts 3200 may have the same shape. Namely, the contact part between the front end surface 368*c* and the second sliding roller member 390 is constantly covered by the guide parts 3201 in driving the variable valve mechanism 350.

In addition, a step part 3202 approximately fitted to each of the guide parts 3201 is formed in the front end part of the relay arm part 368*a* of the center rocker arm 362. The step part 3202 is thin in comparison with its surroundings. A clearance is provided between the step part 3202 and the guide part 3201 so as not to hamper the displacement of the center rocker arm 362. The inlet valve rocker arm 361, the center rocker arm 362, and the swing cam 364 are biased in a direction to be closely contacted with each other by a pusher 386 as an example of a bias mechanism so that their smooth movement is ensured.

As shown in FIG. 7, the electric motor 365 rotates the inlet valve rocker shaft 352 to thereby change the position of the support part 377 (the posture of the control arm 372) supporting the fulcrum arm part 368*b* of the center rocker arm 362 in the inlet valve rocker shaft 352. The posture of the center rocker arm 362 is changed following the change of the position of the support part 377.

The posture of the center rocker arm 362 can be changed in a range from the posture in which the control arm 372 is approximately vertical as shown in FIG. 8 to the posture in which the control arm 372 is substantially tilted in the rotating direction of the camshaft 351 as shown in FIG. 6.

When the posture of the center rocker arm 362 is changed, the degree of the displacement of the cam lift of the inlet valve cam 351*a* to be transmitted to the swing cam 364 is changed. As a result, the posture and swinging in the swing cam 364 are changed, and thus the movement of the inlet valve rocker arm 361 is changed. The posture of the inlet valve rocker shaft 352 is adjusted by the electric motor 365, whereby the operation of the inlet valve 319*a* is adjusted.

The above-mentioned assumed change in the contact part between the second sliding roller member 390 and the front end surface 368*c* includes the change following the change in the posture of the inlet valve rocker shaft 352 due to the electric motor 365.

In this embodiment, a diameter $\phi b$ of the second sliding roller member 390, a diameter $\phi c$ of the needle roller member 366 and a diameter $\phi a$ of the first sliding roller member 367 satisfy the condition: $\phi c<\phi b<\phi a$.

The displacement of the inlet valve cam 351*a* in the variable valve mechanism 350 constituted as above and the load transmitting this displacement are transmitted in the order of the inlet valve cam 351*a*, the center rocker arm 362, the swing cam 364, and the inlet valve rocker arm 361. This transmission path X will be specifically described hereinafter.

The first sliding roller member 367 first receives the load due to the displacement of the inlet valve cam 351*a* because the first sliding roller member 367 is in contact with the inlet valve cam 351*a*. The center rocker arm 362 is displaced according to the displacement of the inlet valve cam 351*a* in response to the load applied to the first sliding roller member 367. The load is transmitted from the front end surface 368*c* to the second sliding roller member 390 (the swing cam 364) by the displacement of the center rocker arm 362.

The swing cam 364 is swung around the support shaft 363 by the load applied to the swing cam 364. The load is then applied to the needle roller member 366 from the cam surface 364*e* by the swinging of the swing cam 364. The inlet valve rocker arm 361 is displaced by the application of the load to the needle roller member 366. The inlet valve 319*a* is open or closed by the displacement of the inlet valve rocker arm 361.

The contact part between the front end surface 368*c* and the second sliding roller member 390 is constantly covered with the guide parts 3201. Therefore, lubricating oil for lubricating between the front end surface 368*c* and the second sliding roller member 390 is spattered around in accordance with the change of the contact part between the front end surface 368*c* and the second sliding roller member 390.

A portion of the dispersed lubricating oil is collided with the guide part 3201, and thus returns to the contact part between the front end surface 368*c* and the second sliding roller member 390, thereby relubricating between the front end surface 368*c* and the second sliding roller member 390. Further, a portion of the dispersed lubricating oil lubricates between the second sliding roller member 390 and the third support axis 364*g*.

In the variable valve mechanism 350 constituted as above, the step part 3202 of the relay arm part 368*a* of the center rocker arm 362 is approximately fitted between the guide parts 3201.

Therefore, the center rocker arm 362 is approximately fitted between the guide parts 3201, whereby the posture of the center rocker arm 362 is prevented from being substantially changed. Namely, the center rocker arm 362 is prevented from rotating around the control arm 372 as the rotation shaft even in the constitution in which error is adjusted by using the control arm 372. In addition, the relative displacement between the swing cam 364 and the center rocker arm 362 to the axial center line direction of the third support axis 364*g* is regulated by the guide parts 3201.

Therefore, the transmission error in the inlet valve cam 351*a* generated with the change in the posture of the center rocker arm 362 is suppressed.

Furthermore, the swing cam 364 is in line contact with the front end surface 368*c* of the center rocker arm 362 through the second sliding roller member 390. Therefore, the contact area of each other can be rendered smaller, so that it is possible to reduce the amount of the lubricating oil to be supplied between the second sliding roller member 390 and the front end surface 368*c*.

Accordingly, the variable valve mechanism 350 of this embodiment can be lubricated with a small amount of the lubricating oil, and at the same time, it is possible to suppress lowering of the transmission efficiency in the displacement of the inlet valve cam 351*a*.

The guide part 3201 covers the contact part between the second sliding roller member 390 and the front end surface 368*c* of the relay arm part 368*a* in the axial center line direction of the third support axis 364*g*. Therefore, a portion of the spattered lubricating oil relubricates the contact part between the front end surface 368*c* and the second sliding roller member 390 by colliding with the guide part 3201, so that a small amount of the lubricating oil can be effectively used.

Furthermore, since a pair of the guide parts 3201 is formed, the displacement of the center rocker arm 362 is easily guided, and at the same time, it is possible to effectively use the small amount of the lubricating oil.

The first sliding roller member 367 is solid from the outer peripheral surface 367*a* to the inner peripheral surface 367*b*, and thus has a high rigidity. Further, the load applied to the outer peripheral surface 367*a* is dispersed in a surface part at which the inner peripheral surface 367*b* and the second support axis 369*b* come into surface contact with each other.

Therefore, the deformation of the first sliding roller member 367 due to the load can be reduced. Further, the friction between the inlet valve cam 351*a* and the center rocker arm 362 can be reduced by using the first sliding roller member 367 in the first transmission part 391.

A part of the inlet valve cam 351*a* contacting with the first sliding roller member 367 and the first sliding roller member 367 constitute a first transmission part 391 of this invention. Namely, the first transmission part 391 is provided with the first sliding roller member 367.

Meanwhile, the contact part between the swing cam 364 and the inlet valve rocker arm 361 in the transmission path X is positioned immediately in front of the inlet valve 319*a*. Therefore, the load acting on this contact part in the transmission path X is relatively small. Accordingly, even when the needle roller member 366 is provided in this contact part in the transmission path X, the deformation of the needle roller member 366 due to the load can be reduced. Further, the friction between the swing cam 364 and the inlet valve rocker arm 361 can be reduced by using the needle roller member 366.

So, this embodiment can get same effect of the first embodiment.

When the diameter $\phi a$ of the first sliding roller member 367 is rendered the same as the diameter $\phi c$ of the needle roller member 366, the difference in the rigidity of them is generated, depending on the type of the roller, that is, the sliding roller and the needle roller. However, when the diameter $\phi a$ is rendered larger than the diameter $\phi c$, the rigidity of the first sliding roller member 367 can be enhanced all the more depending on the size of the roller. So, this embodiment can get same effect of the first embodiment.

In this embodiment, the friction in the second transmission part 392 can be reduced by using the second sliding roller member 390, so that the friction generated in the transmission path X can be reduced in addition to the effect obtained in the first embodiment.

The front end surface 368*c* and the second sliding roller member 390 constitute a second transmission part 392 of this invention. Namely, the second transmission part 392 is provided with the second sliding roller member 390.

In addition, since the diameter $\phi b$ of the second sliding roller member 390 is larger than the diameter $\phi c$ of the needle roller member 366, the rigidity of the second sliding roller member 390 can be rendered larger than that of the needle roller member 366. Therefore, the deformation in the second transmission part 392 can be reduced, so that the transmission loss of the displacement of the inlet valve cam 351*a* can be reduced.

Therefore, this embodiment can produce the same advantages as the second embodiment.

In addition, in the third embodiment, although the diameters $\phi a$, $\phi b$ and $\phi c$ satisfy the condition: $\phi c<\phi b<\phi a$, this invention is not limited to this condition. Even when $\phi c \leqq \phi b<\phi a$, the similar effect can be obtained. Specifically, the difference in rigidity between the sliding roller and the needle roller is generated depending on the type of the roller only by rendering the diameter $\phi b$ of the second sliding roller member 390 the same as the diameter $\phi c$ of the needle roller member 366. However, the diameter $\phi a$ of the second sliding roller member 390 is rendered larger than the diameter $\phi c$ of the needle roller member 366, whereby the rigidity of the second sliding roller member 390 can be enhanced all the more based on the size of the roller. Further, it is possible to further increase the rigidity of the first sliding roller member 367 used for the first transmission part 391 to which the larger load is applied than the second transmission part 392.

Figure 10:
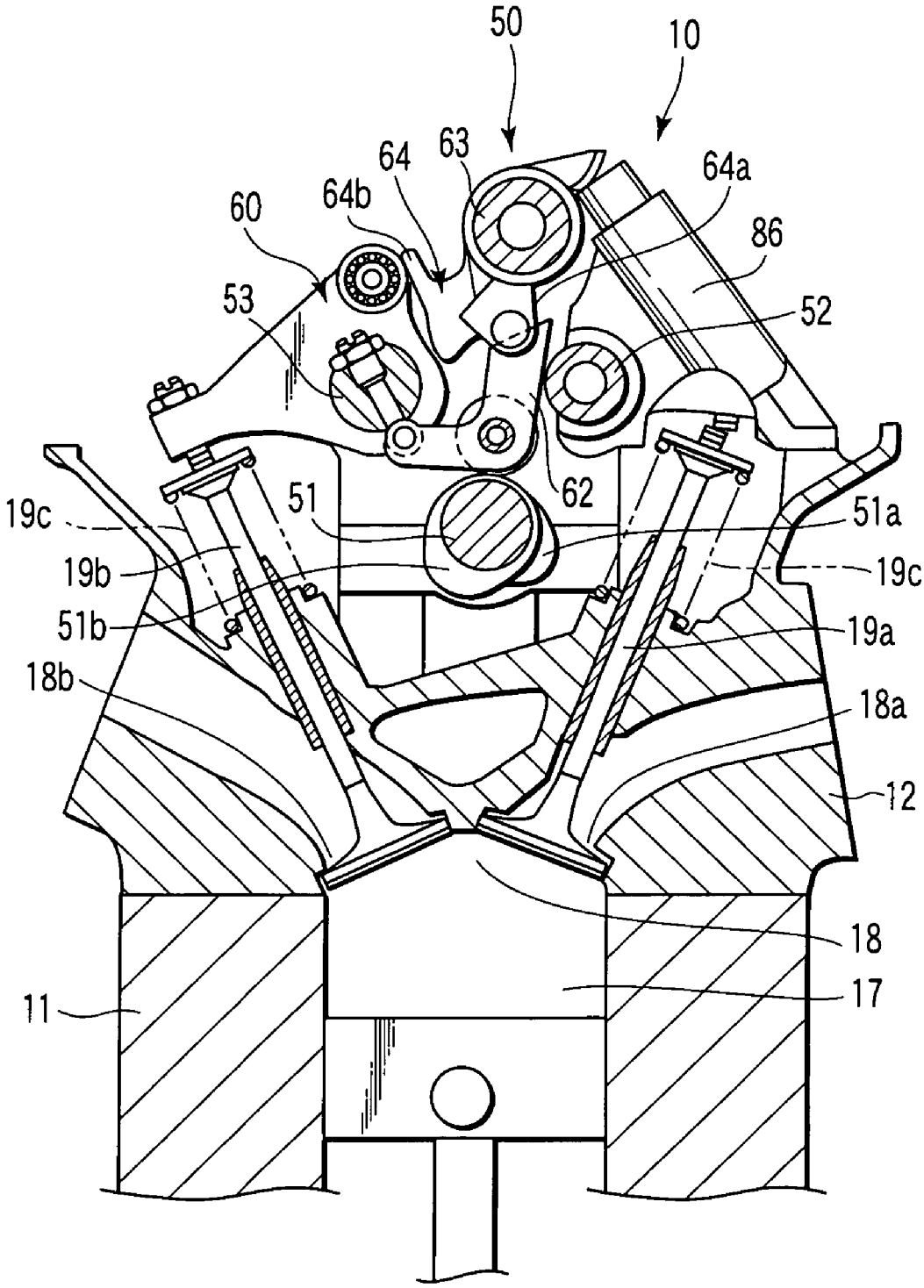
FIG. 10 is a cross-sectional view showing a variable valve mechanism driving a exhaust valve.

In the first, second and third embodiments, although the variable valve mechanism 50 and 350 drive the inlet valve 19*a* and 319*a*, the variable valve mechanisms 50, 350 may drive the exhaust valve 19*b* and 319*b*, for example, as shown in FIG. 10.

In FIG. 10, the variable valve mechanism 50 drives the exhaust valve 19*b*. Similarly, the variable valve mechanism 350 drives the exhaust valve 319*b*, as shown in FIG. 10.

An example of the structure of a variable valve mechanism driving the exhaust valve 19*b*, 319*b* has a reversed structure in which the variable valve mechanism 50, 350 described in the first, second and third embodiments is so designed as to reverse the intake side and exhaust sides.

The variable valve mechanism 350 described above is driven by the exhaust cam 351*b* and drives the exhaust valve 319*b*.

In addition, in the second and third embodiments, the roller member 90 and 390 are provided in the swing cam 64 and 364; however, even if the roller members 90 and 390 are provided in the center rocker arm 62 and 362, the similar effect can be obtained. Further, in the first, second and third embodiments, although the center rocker arm 62 and 362 are provided between the swing cam 64 and 364 and the inlet valve cam 51*a* and 351*a*, it may be provided between the swing cam 64 and 364 and the inlet valve rocker arm 61 and 361.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A variable valve mechanism for an internal combustion engine, comprising:

a camshaft rotatably provided in an internal combustion engine;

a cam formed in the camshaft;

a rocker arm provided in the internal combustion engine and drives a valve;

a swing cam swingably provided in the internal combustion engine and drives the rocker arm by receiving displacement of the cam; and a transmission member interposed between the swing cam and the cam and transmits the displacement of the cam to the swing cam, wherein the rocker arm includes, a rolling roller member which includes a fixed inner ring, an outer ring provided coaxially with the inner ring and accommodating the inner ring in its inside, and a plurality of rolling elements accommodated between the inner ring and the outer ring and supporting the outer ring in a rotatable manner with respect to the inner ring, and receives the displacement of the swing cam in a state that the outer ring is in rolling contact with the swing cam, and in a transmission path through which the displacement of the cam is transmitted to the swing cam, each of a first transmission part, in which the displacement of the cam is transmitted from the cam to the transmission member, and a second transmission part, in which the displacement of the cam is transmitted from the transmission member to the swing cam, includes a sliding roller member which transmits the displacement of the cam on an outer peripheral surface and is rotatably supported by a support part, wherein an inner peripheral surface of the sliding roller member is in surface contact with the support part, and the inner peripheral surface and the support part make a sliding bearing mechanism, wherein the diameter of the outer peripheral surface of each sliding roller member is larger than the diameter of the outer ring of the rolling roller member, and wherein the diameter of the outer peripheral surface of the sliding roller member of the first transmission part is larger than the diameter of the outer peripheral surface of the sliding roller member of the second transmission part.

2. The variable valve mechanism for an internal combustion engine according to claim 1, further comprising:

at least one guide part which regulates relative displacement between the swing cam and the transmission member in an axial center line direction of a rotation shaft of the roller member of the second transmission part.

3. The variable valve mechanism for an internal combustion engine according to claim 2, wherein the at least one guide part has a size covering at least a contact part between the sliding roller member and the swing cam in contact with the roller member or the transmission member.

4. The variable valve mechanism for an internal combustion engine according to claim 2, wherein the at least one guide part includes a pair of guide parts provided on both sides of the sliding roller member with the sliding roller member interposed therebetween.

5. The variable valve mechanism for an internal combustion engine according to claim 3, wherein the at least one guide part includes a pair of guide parts provided on both sides of the sliding roller member with the sliding roller member interposed therebetween.

* * * * *